US005286142A

United States Patent [19]

Hoyt et al.

[11] Patent Number: 5,286,142

[45] Date of Patent: Feb. 15, 1994

[54] REDUCED MOMENT ANCHOR HUB

[75] Inventors: Robert M. Hoyt; Daniel V. Hamilton, both of Centralia, Mo.

[73] Assignee: A. B. Chance Company, Centralia, Mo.

[21] Appl. No.: 34,101

[22] Filed: Mar. 22, 1993

[51] Int. Cl.[5] ..... E02D 5/80

[52] U.S. Cl. ..... 405/244; 52/157; 405/258; 405/259.1

[58] Field of Search ..... 405/259.1, 258, 244, 405/259.5; 52/157-162, 155, 156; 175/322, 394, 400

[56] References Cited

U.S. PATENT DOCUMENTS

| | | | |
|---|---|---|---|
| 505,811 | 10/1893 | Brown | 52/157 X |
| 888,917 | 5/1908 | Lucas | 52/157 |
| 1,940,938 | 12/1933 | Chance | 52/157 |
| 3,148,510 | 9/1964 | Sullivan | 405/259.1 |
| 3,828,562 | 8/1974 | Petres | 405/259.1 |
| 4,334,392 | 6/1982 | Dziedzic . | |
| 4,467,575 | 8/1984 | Dziedzic . | |

*Primary Examiner*—Dennis L. Taylor

*Attorney, Agent, or Firm*—Hovey, Williams, Timmons & Collins

[57] ABSTRACT

An earth anchor apparatus having reduced bending moment characteristics is provided, including a longitudinally extending hub having first and second axial ends. Affixed to the hub between the ends thereof is a radially extending load-bearing element, including a leading edge intersecting the hub and structure extending radially outward from the hub in a generally helical direction. The apparatus further includes an elongated anchor rod having first and second ends, and means for coupling the rod to the earth anchor. The coupling means includes means for reducing bending moments in the rod during movement thereof.

20 Claims, 3 Drawing Sheets

Fig. 1.
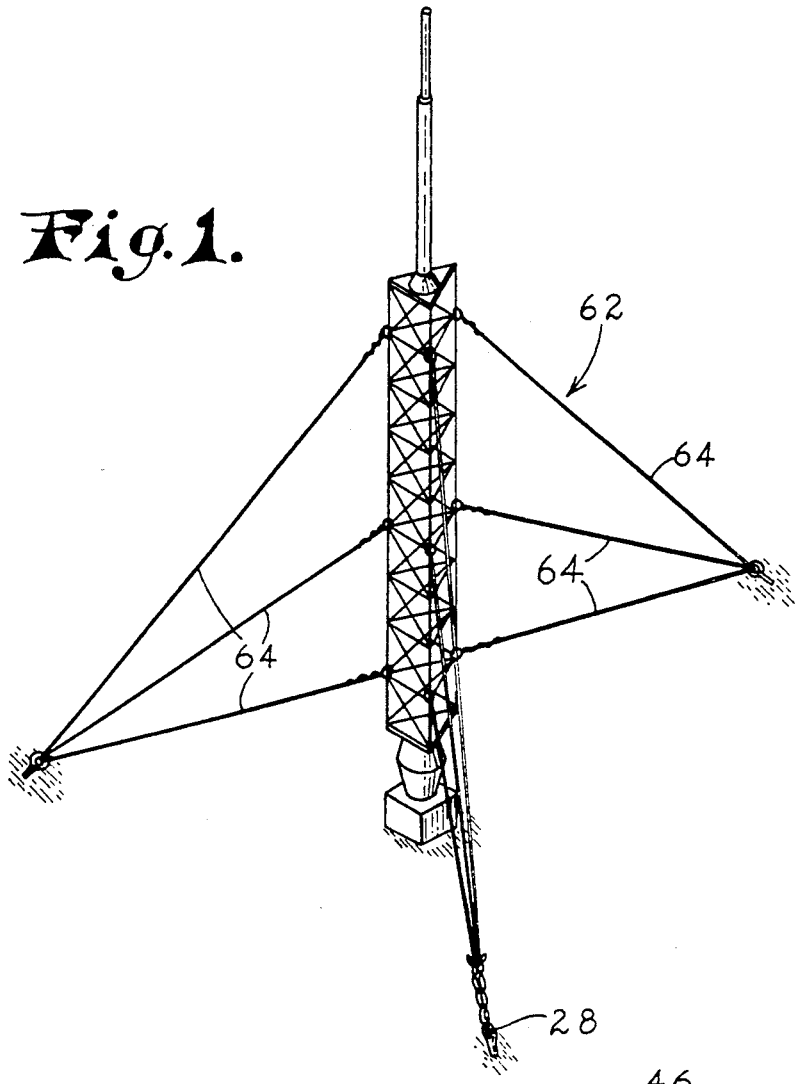
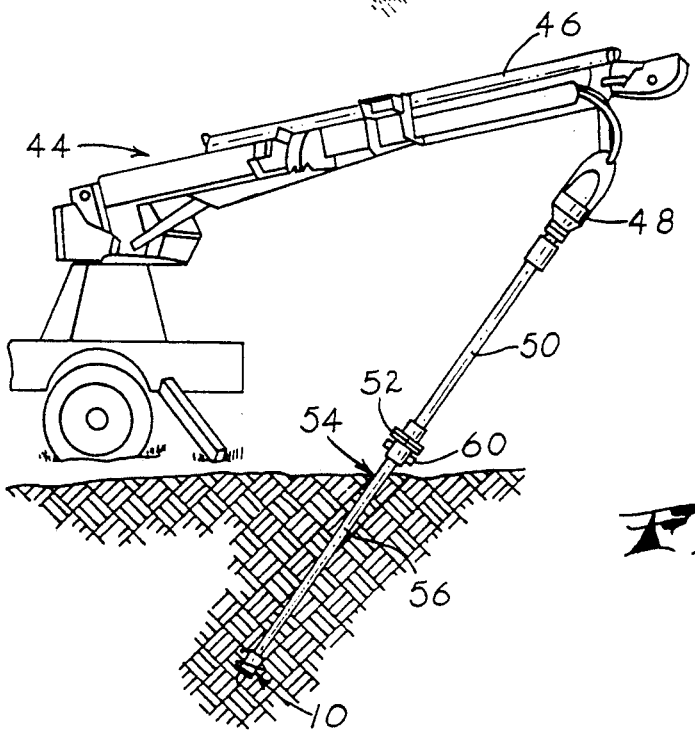
Fig. 2.

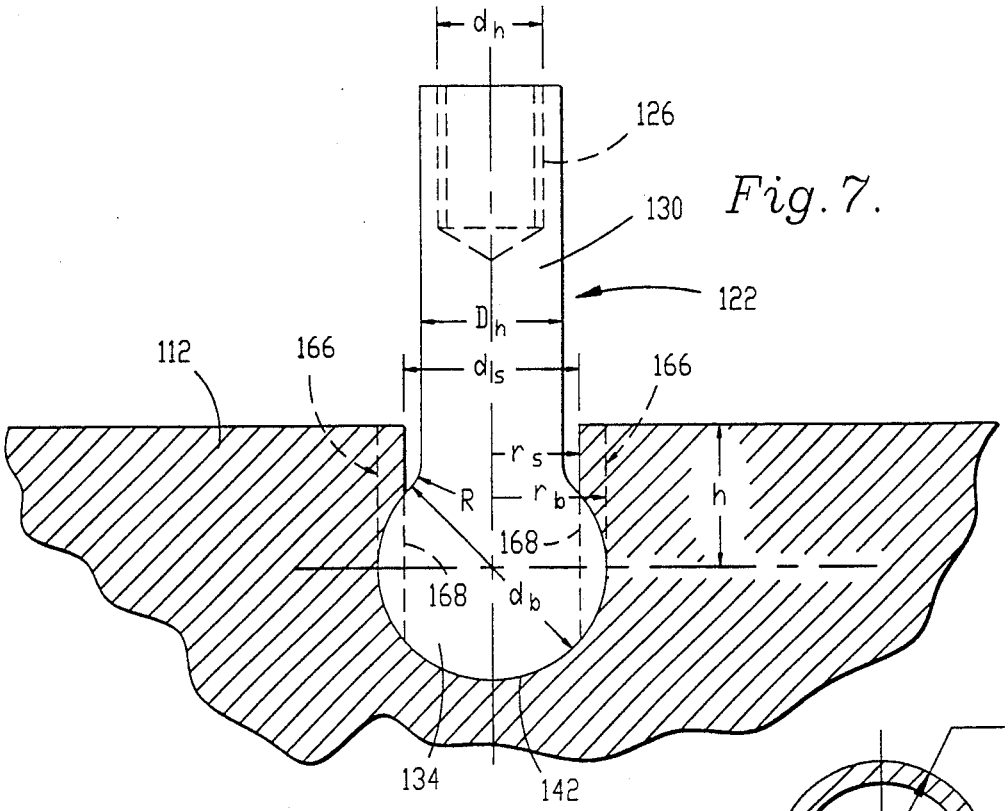
Fig. 7.
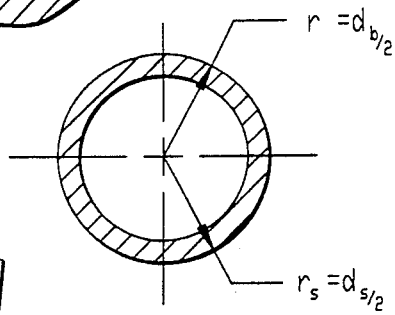
Fig. 9.
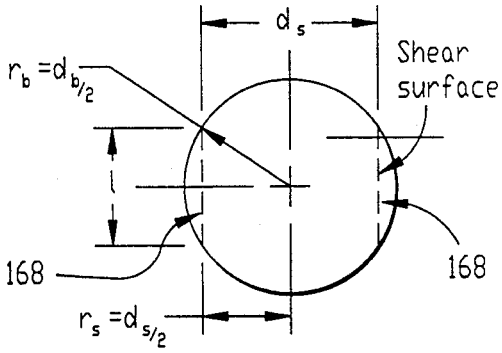
Fig. 10.
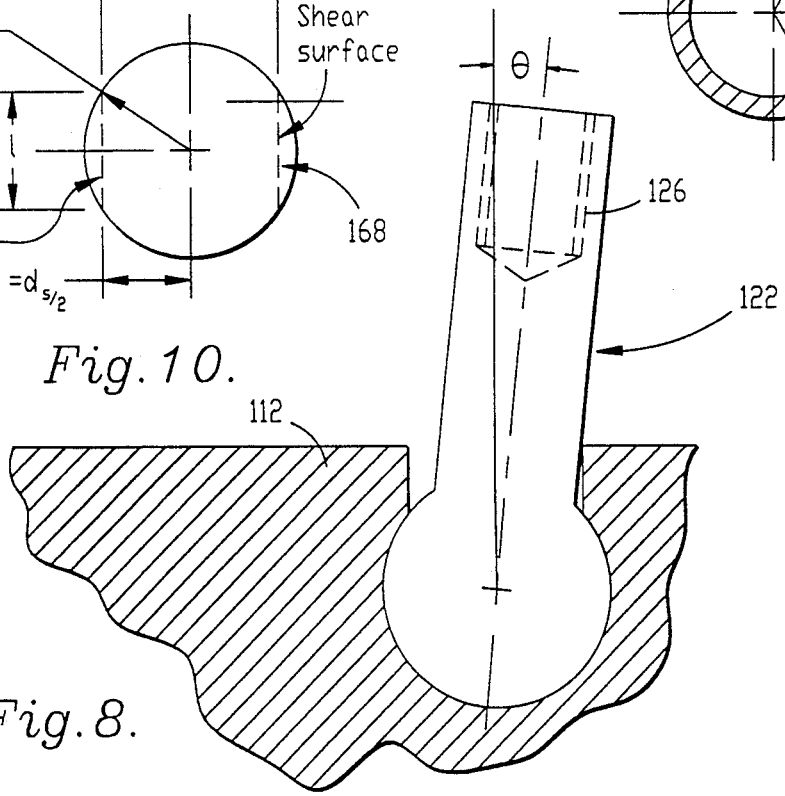
Fig. 8.
Fig. 11.
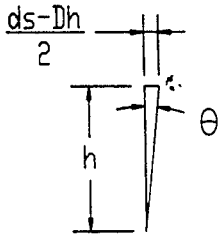

REDUCED MOMENT ANCHOR HUB

BACKGROUND OF THE INVENTION

1. Field of the Invention

The present invention relates generally to a screw anchor having a guy-wire-rod threadably secured to a boss within the hub of the anchor. The rod-receiving boss is constructed in a manner that will allow the rod to be disposed at a moderate angle with respect to the axis of the anchor without significantly impairing the ability of the rod or the anchor rod boss to withstand the tension forces imparted by a guy-wire connected thereto.

In a first embodiment, the rod boss is designed to bend longitudinally within certain limits, thus significantly alleviating stresses and strains on the guy-wire-rod and the rod boss when the rod is not axially aligned with the anchor. In an alternate embodiment, the bending moments that would otherwise be imposed on the rod boss and the guy-wire-rod by a nonaligned rod is essentially eliminated through the use of a ball and socket boss construction.

2. Discussion of the Prior Art

It is known to provide a modular screw anchor having an earth-penetrating lead and a one-piece hub and helix which surrounds an upper internally threaded segment of the lead point. An elongated rod of this type of anchor has an end adapted to be threaded into the lead point, and generally has threads at the opposite end for attachment of an eye which facilities connection of a guy wire to the anchor. Exemplary modular anchors are shown and described in U.S. Pat. Nos. 4,334,392 and 4,467,575, both assigned to the assignee hereof.

During installation of the modular anchor as illustrated in the '575 patent, the rod is first threaded into the uppermost end of the lead point whereupon a tubular wrench is then telescoped over the rod in driving engagement with the hub portion of the screw anchor. The wrench has locking dogs on its upper end for engagement with temporary retaining means such as a holding collar or equivalent means threaded on the upper end of the rod to hold the anchor assembly connected to the wrench until the locking dogs are released. Upon connection of the upper end of the wrench to a power source for rotational movement, simultaneous application of downward force and rotational torque on the assembly causes the anchor to be driven into the ground to the desired depth. Similar anchor construction is described and shown in the '392 patent except that the rod may either be integral with the lead point, or threaded throughout the length of the latter. A certain degree of axial misalignment of the rod with the lead point did not have an adverse effect on the integrity of the anchor assembly in most instances because of the f act that the lead point was not integrally attached to the hub and helix.

Screw anchors made up of components which, for example, are welded together presenting a unitary structure made up of a helix, hub and rod-receiving boss however, poses a problem when misalignment of the guy wire with respect to the anchor axis occurs. In this instance, the maximum bending moment which can exist at the threaded joint between the guy-wire-rod and the rod-receiving boss is controlled by the strengths of the anchor rod and boss in the vicinity of the joints.

Furthermore, development of an essentially one-piece cast screw anchor having an integral lead point, tubular hub, peripheral helix, and internally threaded boss cast within the hub for receipt of the threaded end of the guy-wire-rod, also presents the potential problem of undue stresses being placed on the rod/boss joint if the rod is not properly aligned with the axis of the anchor. The one-piece cast anchor is installed in the same fashion as the modular screw anchor. The wrench is telescoped into the hub in surrounding relationship to the rod-receiving boss while the locking dogs at the top end of the wrench hold the anchor assembly in position during installation. Release of the locking dogs allows the wrench to be withdrawn leaving the upper threaded end of the rod exposed for attachment of eye means and a guy wire to the rod.

Typical applications of the rod and earth anchor assembly include stabilization of upright structures, such as for example utility poles, towers for supporting electrical distribution lines, radio and television transmission towers, light standards, and similar structures. When used for these purposes, the anchor is first driven into the ground, and then a respective guy wire is connected to the anchor rod eye. Thus, the relative positioning of the anchor assembly with respect to its guy wire is of critical importance. The anchor assembly and guy wire must be connected and tightened in such a manner that the full benefit of the earth anchor's holding capacity is exploited. This means that the guy wire and the anchor assembly must define, as closely as possible, a straight line from the connection of the guy wire with the tower structure to the tip of the anchor member lead point in the ground. It is widely recognized in the industry that the anchor must be aligned within 10 degrees of the guy wire. In practice, it is standard procedure to specify that anchors be installed with their axis within 5 degrees of the guy wire.

If the guy wire and anchor assembly are not properly aligned as described above, the tightening of the guy wire will adversely affect the anchor rod and the threaded connection of the latter to the rod boss, particularly in instances where the screw anchor is a unitary structure with the rod receiving boss being integral with the anchor hub. This result obtains because as the guy wire is tightened, the end of the anchor rod connected to the guy wire will attempt to align itself with the wire. The rod starts out aligned with the anchor and is pulled out of that alignment in an attempt to align itself with the guy wire as it is tensioned. At the same time, however, the other end of the anchor rod, screwed into the earth anchor hub, will endeavor to maintain alignment with the anchor. This situation is unacceptable, because the rod, in its effort to align itself with the wire, undergoes bending moments.

Furthermore, failure to properly align the anchor rod and guy wire imposes a bending moment and resulting bending stress on the threaded joint between the anchor rod and the rod-receiving anchor hub or boss. The sum of the tensile stresses due to bending and to the applied guy wire load is limited to the tensile strength of the anchor rod. Therefore, the useful guy wire load is reduced by an amount that is directly proportional to the magnitude of the bending stresses, which in turn is directly proportional to the magnitude of the bending moment. It thus follows that reducing the bending moment at the threaded joint will increase useful guy wire load capacity.

SUMMARY OF THE INVENTION

It is thereof ore an object of the present invention to provide an earth anchor assembly which is constructed to limit bending moments on the assembly attributable to axial misalignment of the anchor rod with the guy wire attached thereto, thereby increasing the maximum useful load capacity of the screw anchor assembly. This, in turn, reduces the likelihood that fracture of the rod or cracking of the anchor hub or boss will occur at anytime throughout the anchor's useful life. Reducing the bending moment on the rod receiving boss significantly increases the allowable load on the anchor assembly.

It is a further object of the present invention to provide an earth anchor assembly which includes boss structure adapted for secure connection with the anchor rod, wherein the boss structure is provided with means permitting relative movement of the anchor rod and boss with respect to the remainder of the anchor structure for the purpose of alleviating bending stresses and strains being imposed on the anchor rod and the connecting boss therefor.

In accordance with the present invention, a combination earth anchor and installation unit includes an earth anchor having an axially extending, transversely polygonal, tubular hub which houses a separate elongated rod receiving boss. A load-bearing helix is affixed to the outer periphery of the hub and projects outwardly therefrom in a helical direction. The combination further includes an elongated rod which is threaded at both ends, has an eye threaded over one end for connection to a guy-wire, and is threaded at its opposite end for threaded interconnection with the boss. The rod receiving boss is constructed in a manner to reduce bending moments in the rod and the boss receiving such rod.

This may take the form of an anchor rod receiving boss which is capable of deflecting along its longitudinal length without fracture, or a ball and socket boss construction which rotates to a limited extent relative to the anchor hub in order to eliminate bending stresses being imposed on the connecting rod and the rod receiving anchor boss.

BRIEF DESCRIPTION OF THE DRAWINGS

A preferred embodiment of the invention is discussed in detail below with reference to the attached drawing figures, wherein:

FIG. 1 is a perspective view of a typical upright structure such as a tower which is guyed using screw anchors embodying the novel features of the present invention;

FIG. 2 is a side elevational view of the anchor apparatus illustrating the manner in which the anchor is installed in the ground through the use of a wrench connected to a power source for effecting down pressure thereon as-well as to rotate the anchor;

FIG. 7 is an essentially schematic illustration of the ball and socket boss structure shown in FIGS. 5 and 6 and depicting a number of the dimensional factors that should be taken into account in designing screw anchor boss structure that meets the requisites of the present invention;

FIG. 8 is a view similar to FIG. 7 but showing the rod receiving boss structure tilted at an angle relative to the normal symmetrical position thereof shown in FIG. 7;

FIG. 9 is a schematic, horizontal sectional representation of the bearing area of the spherical segment received within the anchor socket therefor, and setting forth certain of the terms in the design formulas described hereinafter;

FIG. 10 is a schematic representation of the shear surfaces of the spherical segment and setting forth certain of the terms in the design formulas described hereinafter; and FIG. 1 is a geometric depiction of the angle of rotation O of the ball in the socket.

DETAILED DESCRIPTION OF THE PREFERRED EMBODIMENT

Figure 3:
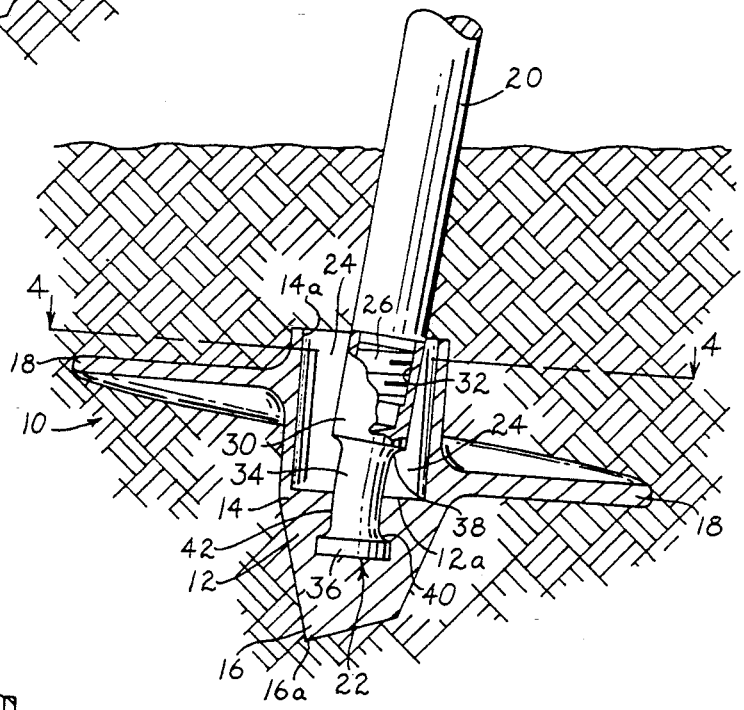
FIG. 3 is a vertical sectional view of a preferred embodiment of the anchor apparatus inserted in the ground, with a portion broken away and also in section and showing the novel boss structure for connecting a guy-wire rod to the anchor in a manner providing compensation for non-axial alignment of the anchor rod with the anchor hub.

The earth screw anchor assembly of the preferred embodiment of this invention is denoted by the numeral 10 in FIG. 3 of the drawings. For purposes of illustration only, anchor 10 is depicted as being of one piece construction, preferably formed by a casting technique. Anchor 10 thus has a main body 12, an integral, elongated, transversely square, open end hub 14, a lead point 16 extending from main body 12 in a direction away from the open end of hub 14, a load bearing helix 18, a connecting rod 20, and a boss generally designated 22 for joining the anchor rod 20 to main body 12 of the anchor 10.

In specific detail, the lead point 16 integral with main body 12 of anchor 10 may, for example, have a tip 16*a* presenting an edge for facilitating entry of the anchor into the ground. Hub 14 has inner side walls 14*a*, which along with the inner wall 12*a* of main body 12 present a rectangular drive wrench receiving socket 24.

The helix 18 connected integrally to the outer wall surface of hub 14 projects outwardly therefrom and functions to cause the anchor to be forced into the ground as it is rotated during installation and also serves as the principal load bearing element of the anchor.

Tension anchor rod 20 connects the anchor body to structure to be guyed in its preferred form is an elongated member having threads 26 at both ends thus permitting connecting structure such as eye 28 (FIG. 1), to be secured to the end of the rod 20 projecting outwardly from the ground. Alternatively, where the anchor 10 is driven into the ground to a depth which exceeds the length of a single rod section, the connecting rod assembly is made up of a series of interconnected rod sections joined together in end-to-end relationship.

Boss 22 has a length 30 telescoped within hub 14 and provided with an internally threaded passage 32 for complementally receiving the end 26 of rod 20. The segment 34 of boss 22 is of reduced diameter relative to the diameter of length 30 and is integrally joined to enlarged section 36 which is of the same diameter as length 30. Radiused fillets 38 and 40 join the outer surface of section 36 to the central body of segment 34, and length 30 to segment 34 as shown in FIG. 3. In practice, bar stock of the diameter of length 30 may be employed to produce segment 34 by machining away a portion of the stock in a manner leaving the radiused fillets 38 and 40.

Also as is evident from FIG. 3, main body 12 of anchor assembly 10 has a recess or socket 42 extending downwardly from the inner wall 12*a* which complementally receives a portion of the segment 34 and enlarged section 36. Thus, the part of boss 22 recessed in main body 12 of anchor assembly 10, and the socket 42 complementally receiving that part of the boss 22 are both configured to present an inverted-T in cross-section. Preferably, during casting of the main body 12 of anchor 10, boss 22 is inserted in the mold, and the metal cast around the segment 34 an enlarged section 36 of the boss 22. Helix 18 is also formed integrally with main body 12 during this casting process.

Boss 22 is formed of a type of metal such that the reduced diameter segment 42 thereof within socket 24 defined by hub 14, may flex and bend to a certain degree when anchor 10 is installed in disposition such that the axes of hub 14 and main body 12 as well as lead 16, are misaligned with the line of pull on guy rod 20. This limits the bending moment in the region of the rod/boss joint to that which will cause bending within segment 34, thus allowing rod 20 to align itself with guy 64 at a lower stress value than would have been the case if rod 20 itself had bent.

A typical method of installing an earth anchor assembly is shown schematically in FIG. 2. For purposes of illustration and not as a limitation on the nature and construction of anchor assembly 10, it is presumed that an anchor rod 20 is threaded into boss 22 as shown in FIG. 3.

A utility truck such as the one designated by the numeral 44 in FIG. 2 may be employed to install anchor assembly 10 to a desired depth in the ground. Truck 44 is of the type having a hydraulically actuated boom 46 which may be rotated as well as swung vertically. Boom 46 carries a hydraulic drive motor 48 on the outer end thereof. Kelly bar 50 secured to the drive shaft of the hydraulic motor 48 has an adapter 52 on the lower end which is adapted to be releasably coupled to a drive wrench broadly designated 54. The elongated, transversely square tube 56 of installation wrench 54 is of dimensions such that it will complementally fit within socket 24 of hub 14 in driving engagement therewith. Locking dog structure 60 at the upper extremity of tube 56 includes a pair of opposed manually manipulable dogs which releasably engage anchor rod 20, for releasably fixing the anchor assembly 10 to wrench 54.

During installation of anchor assembly 10, the threaded end 26 of anchor rod 20 is first threaded into passage 32. Telescoping of the drive wrench 54 over rod 20 brings the retaining collar into proximity with the locking dog structure 60. The dogs are moved inwardly to trap the rod 20 in tube 56 thereby locking the anchor assembly 10 to the installation wrench 54.

Where screw anchor assembly 10 is to be used to guy upright structure as generally denoted by the numeral 62 in FIG. 1, anchor assembly 10 is forced into the ground as it is rotated by the hydraulic motor 48, at an angle with respect to the vertical. That angle is controlled by the angularity of the guy-wire 64 to be interposed between the eye 28 of the installed earth anchor assembly 10 and the structure 62 to be guyed. The angle at which the wrench is to be installed with respect to the vertical is specified by the engineer and this information is provided to the installer as to each anchor assembly 10. Generally speaking, the tolerance for such anchor angle is within 51 of that specified.

After the anchor has been driven into the ground to a level where at least a required holding power (tension force applied to the installed anchor) is achieved, the locking dogs are released and wrench 54 withdrawn along its installation line. Guy-wire 64 is then attached to eye 28 or other equivalent means of the rod 20.

As noted previously, a primary object of the invention is to increase the ability of the rod to tolerate a certain degree of misalignment between anchor rod 10 and the guy-wire 64 connected thereto by limiting the bending moment induced in the rod. In order to assure that the anchor provides its maximum holding power for the soil in which it is installed, the tension applied to the rod 20 by securing of the guy-wire 64 thereto, should be along a straight line through the axis of the rod 20, and the axes of hub 14 and main body 12 of the anchor 10. Variation from that straight line relationship, if severe enough, can actually result in fracture of the boss in which the anchor rod is connected, or to other components of the anchor itself. Particularly vulnerable in this respect is the threaded connection of the anchor rod to the internally threaded boss of the anchor.

If the anchor rod 20 is subjected to a misaligned load, P, that misaligned load P can be resolved into components $P_x$, and $P_y$ which are aligned with and normal to the rod, respectively. The component $P_x$ induces tension in the rod while $P_y$ causes bending moment. Any bending moment will be distributed along the length of the rod. However, the highest bending moment is at the anchor itself. This theoretical model therefore represents the physics involved when an anchor is installed out of axial alignment with its guy-wire.

The tension and bending moments produce strains and stresses within rod 20 and connecting structure such as boss 22. The strains are related to the tension and bending moment through the geometry of the parts and properties of the materials from which such parts are constructed, while the stresses are related to the strains via material properties alone. The combined strains and stresses may therefor be resolved as the algebraic vector sums represented by the combined strains and stresses. Structural behavior therefor is determined by the material properties of the components with failure occurring if the limits of such material properties are exceeded.

Elastic behavior occurs as long as the strains stays below the material's elastic limit. If the load is removed, the part returns to its original shape. However, the part will fracture if the strain exceeds the material's ultimate limit. It is preferred in this respect that the critical components of assembly 10 be fabricated from materials that will deform after the strain reaches the elastic limit of the parts under load, rather than fracturing. Thus, ductile behavior is preferred because misalignments and temporary overloads can only cause permanent distortion of the part or parts and not fracture, as would occur with brittle behavior.

The screw threads joining anchor rod 20 to boss 22 perform as notches where local areas of relatively high strain develop in the vicinity of individual notch tips.

The adverse notch effect increases with increasing depth of notch and decreasing radius of notch tip. The concentration factor, k, associated with a notch, may be defined as the ratio of the maximum strain to stress in the notched member divided by the maximum which would occur without the notch. For the threads used to connect rod 20 to boss 22 of anchor 10, the concentration factor k is believed to be about 2. Because the high strain on the threads is so localized, very little overall deformation takes place before the strain around the notch reaches the material I s ultimate limit and fracture occurs. Thus a relatively small misalignment between the anchor rod and the guy-wire can result in fracture of the rod or boss at their point of threaded connection. Fracture occurs primarily at the end of the rod adjacent the boss 22 rather than at the guy end of the anchor rod because the bending strains are much higher at the anchor end than at the opposite end of the rod.

The flexible segment 34 of boss 22 of anchor 10 should be designed such that the portion of the segment 34 between wall 12*a* of main body 12 and length 30 of the boss 22 flexes to an extent, without fracture to allow substantial alignment between the guy-wire axis and the length 30 of boss 22, as well as the anchor rod 20 itself. This is accomplished by constructing the boss 22 of material having properties such that when machined to the configuration illustrated in FIG. 3, sufficient tensile strength and ductility is provided while minimizing bending stiffness. A suitable material for fabrication of boss 22 has been found to be hot-rolled medium carbon steel, such as AISI 1035. This material has much greater ductility than the steel from which anchor rod 20 is constructed.

The diameter of boss 22 is determined by the thread size of the threaded interconnection between rod 20 and boss 22. The cross-sectional area remaining after the threads are cut must be sufficient to resist the load being transmitted through the threaded connection. As previously indicated, the area required is somewhat larger than would otherwise be necessary because of the notch effect. Also, the segment 34 having reduced cross-section must be of the thickness such that it will support the tension load thereon. The cross-sectional area of segment 34 may be less than would otherwise be the case if it were not for the radiused fillets 38 and 40 merging the outer surface of segment 34 into length 30 and enlarged section 36 respectively. The notch effect is thereby minimized by the fillets 38 and 40.

Figure 4:
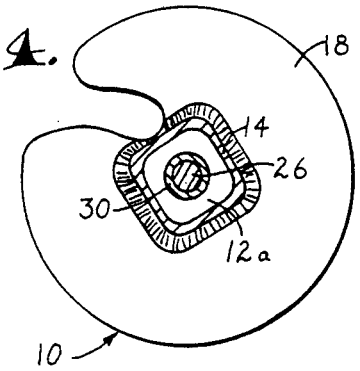
FIG. 4 is a horizontal cross-sectional view of the anchor apparatus as shown in FIG. 3 and taken on the line 4—4 of that figure.

In accordance with this invention, the following calculations may be used to develop a specific hub design, for the preferred embodiment shown in FIGS. 3 and 4, where:

$A_r$=cross-sectional area of rod in threaded section (a given)

$D_r$=outside diameter of rod in threaded section (a given)

$F_{yr}$=yield strength of rod material (a given)

$k_r$=concentration factor for rod threads (a given)

$A_h$=cross-sectional area of hub in threaded section $A'_h$=cross-sectional area of hub in reduced section $d_h$=inside diameter of hub in threaded section (a given)

$D_h$=outside diameter of hub in threaded section $D'_h$=outside diameter of hub in reduced section $F_{yh}$=yield strength of hub material (a given)

$k_h$=concentration factor of the hub threads (a given)

$k'_h$=concentration factor f or reduced section of hub

L=length of reduced section protruding from casting

R=fillet radius $$\frac{A_hF_{yh}}{K_h} \geqq \frac{A_rF_{yr}}{K_r} \rightarrow A_h \geqq A_r\frac{F_{yr}}{F_{yh}}\ \frac{k_h}{k_r}$$

$$\frac{A'_hF_{yh}}{K_h} \approx \frac{A_hF_{yh}}{K_h} \rightarrow A'_h \approx A_h\frac{k'_h}{k_h}$$

$$A_h = \frac{\pi(D_h^2 - d_h^2)}{4} \rightarrow D_h = \sqrt{4\frac{A_h}{\pi} + d_h^2}$$

$$A'_h = \frac{\pi D'^2_h}{4} \rightarrow D'_h = \sqrt{\frac{4A'_h}{\pi}}$$

p1 $k'_h$ is a function of $D_h$, $D'_h$, and R, and can be found in standard reference books on Mechanics of Materials.

$L \geqq D'_h$

DESCRIPTION OF AN ALTERNATE EMBODIMENT

Anchor assembly 110 is also preferably of cast construction and thereby has a main body 112, an integral, open end, transversely square hub 114, a lead point 116, an outwardly projecting load bearing helix 118, a connecting rod 120, and a boss 122 connecting the anchor to the main body 112 of anchor 110. Anchor rod 120 is similar to rod 20 and is of the same dimensions as the latter. In like manner, rod 120 has threads 126 on the normally lowermost end thereof for threaded interconnection with boss 122.

Figure 5:
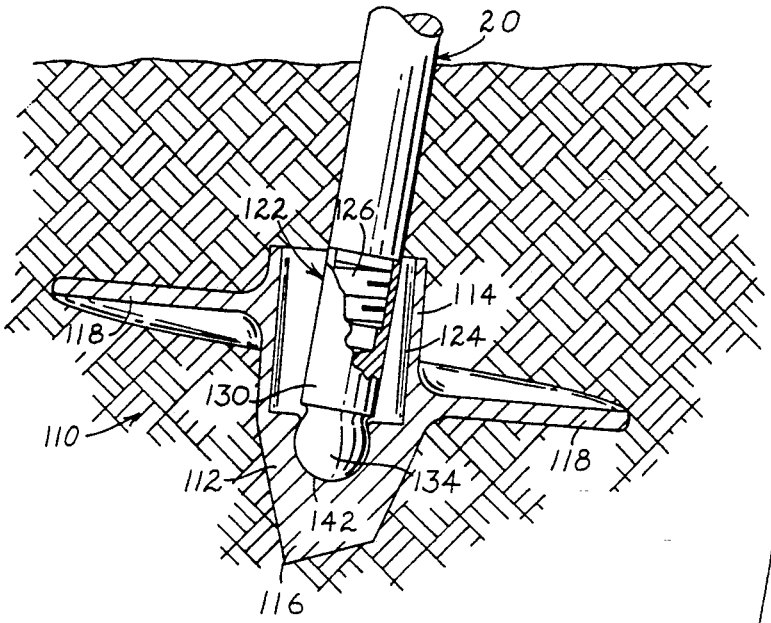
FIG. 5 is a vertical cross-sectional view similar to FIG. 3 but illustrating anchor structure in the ground which has an alternate ball and socket embodiment of the boss structure for connecting the guy-wire rod to the main body of the anchor.

The principal difference between boss 22 and boss 122 is that the latter is pivotally connected to main body 112 through a ball and socket arrangement as is most evident from FIG. 5. Thus, the main length 130 of boss 122 has a generally spherical segment 134 on the extremity thereof presenting an enlarged section remote from anchor rod 120. Main body 112 of anchor 110 likewise is provided with a generally semi-spherical recess or socket 142 which pivotally and complementally receives spherical segment 134.

It can be seen from FIG. 5 that in the event misalignment occurs between the longitudinal extent of a guy wire 64 and the axes of hub 114 and main body 112, boss 122 is capable of pivoting within hub 114 through a displacement to accommodate the misalignment of the anchor with respect to the guy wire.

Figure 6:
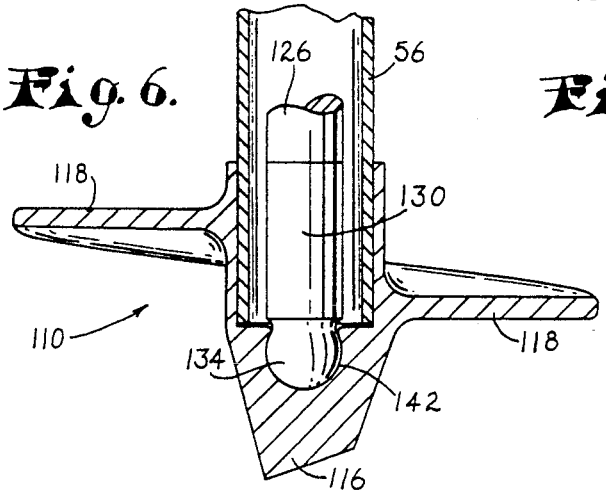
FIG. 6 is a vertical cross-sectional view of the anchor depicted in FIG. 5 but showing a driving wrench telescoped into the hub of the anchor for driving the anchor into the ground.

Installation of the anchor assembly 110 is essentially the same as that described with respect to the installation of anchor assembly 10. As shown in FIG. 6, the transversely square drive wrench 56 is telescoped into the socket 114 of anchor 110 to rotate and drive the anchor into the ground. Again, the material chosen for the construction of boss 122 should be such that spherical enlargement 134 is capable of withstanding tension loads imposed on anchor rod 120. It can be seen f rom FIG. 5 that boss 122 and thereby rod 120 may pivot about ball segment 134 through a displacement accommodating misalignment of the guy wire with the anchor rod 120. During casting of anchor 110, a release or parting agent is first applied to the outer surface of spherical enlarged section 134 so that when the molten metal is cast around spherical section 134 of boss 122, the molten metal will not adhere to the outer surface of the ball. If desired, means (not shown) may be provided for allowing pivoting movement of boss 122 and thereby connector rod 120, while preventing rotation of boss 122 about its longitudinal axis. As the guy wire is tensioned, the rod 120, and thus the boss 122 both pivot until the rod is brought into axial alignment with the guy wire. In this instance, the transverse component $P_y$ and the bending moments in the rod are essentially zero.

Although the invention hereof is especially useful in screw anchors having an installing wrench receiving hub which surrounds the hub for the guy-wire rod, it is to be understood that the principles hereof are also useful in connection with other types of earth anchors including flat plate anchors, or expanding plate anchors. In the case of a flat plate anchor, the main body portion of the anchor has an outwardly extending, earth engaging, load bearing edge portion which projects outwardly from the main body of the anchor. In this type of anchor, a hole is drilled into the ground at an angle with respect to the axis of the guy-wire to be attached to the anchor. A passage is then drilled into the ground at an angle with respect to the hole receiving the anchor, along a line approximately aligned with, or parallel to the draft axis of the guy-wire. The plate anchor is placed in the first hole at the level of the intersecting passage, and then the guy-wire anchor rod is inserted in the passage and connected to the plate anchor as by threading of the anchor rod into the main body of the anchor plate. The passage, and the plate receiving hole are then suitably back filled. The main body of the plate anchor is provided with a boss of the characteristics previously described, and illustrated in either FIG. 3, or in FIG. 5.

Another embodiment of the anchor may be of the segmented expanding plate type where a passage is drilled in the ground in alignment with the draft angle of the guy-wire and an expanding anchor inserted in the passage. This type of anchor will also have an anchor body and an anchor rod receiving boss connected to the anchor body as illustrated in FIGS. 3 or 5. Exertion of a pull on the anchor rod connected to the anchor boss causes the segmented plate of the expandable anchor to be moved radially outwardly into the surrounding earth thus presenting outwardly projecting earth engaging load bearing surfaces.

In accordance with the embodiment of the invention illustrated in FIGS. 5–8, the calculations hereunder may be employed to develop a specific design for ball and socket anchor assembly 110. Referring initially to FIGS. 7 and 8, wherein a number of the factors that must be taken into account in carrying out the calculations are indicated in these drawings, the main body or base 112 of the anchor is shown schematically and appropriately crosshatched. The length 130 of boss 122 has a threaded section 126 at the upper end thereof. The spherical segment is indicated by the numeral 134, while the socket is designated 142. The shear surface of the base material 112 of the anchor is identified by the vertical dashed lines 166. The shear surfaces of spherical segment 134 are indicated by the vertical dashed lines 168.

The formulas hereinafter employ the following terms and parameters, certain of which are set forth in FIGS. 7–10:

$D_h$=outside diameter of hub.

$d_h$=inside diameter of hub in threaded section (a given)

$A_h$=cross-sectional area of hub in threaded section.

$d_r$=outside diameter of rod in threaded section (a given).

$A_r$=cross-sectional area of rod in threaded section (a given)

$F_{yr}$=yield strength of rod material (a given).

$K_r$=concentration f actor f or rod threads (a given).

$K_h$=concentration factor for hub threads (a given).

$d_b$=diameter of ball.

$d_s$=diameter of socket in the base of anchor above ball.

$r_s$=radius of socket above ball in anchor base $r_s=d_s/2$.

$r_b$=radius from centerline of hub to shear surface in anchor base $r_b=d_b/2$.

h=vertical distance from horizontal centerline of ball to surface of anchor base.

$A_{sh}$=cylindrical shear surface area in anchor base.

$f_{yh}$=yield strength of hub material (a given).

$f_{syh}$=hear strength of hub material.

$$\left(\text{Equals } F_{yh}\left(\frac{\sqrt{3}}{3}\right), \text{ a given}\right)$$

$F_{ya}$=yield strength of anchor base material (a given)

$F_{syA}$=shear strength of anchor base material.

$$\left(\text{Equals } F_{yA}\left(\frac{\sqrt{3}}{3}\right), \text{ a given}\right)$$

$k_b$=concentration factor for ball in socket used for bearing calculation. $K_b$ is a function of $d_b$, $d_s$ and R (a given).

$A_b$=bearing area of ball on socket in anchor base.

$A_{shb}$=cylindrical shear surface area in ball of hub.

1=vertical distance describing shear surface in ball of hub.

R=fillet radius where hub transitions into ball.

$\Theta$=rotation angle of ball in socket as measured from the vertical. $\Theta$ is a function of $D_h$, $d_s$, h, or $\Theta=f(D_h, d_s, h)$ $K_{bs}$=concentration factor for ball in socket used for shear calculation. $K_{bs}$ is a function of $d_b$, $d_s$ and R (a given).

In order to fabricate a ball and socket anchor assembly 110 in accordance with the present invention, the given variables are used to develop a design that satisfies the following conditions.

Axial Loading:

$$\frac{A_hF_{yh}}{K_h} \geqq \frac{A_rF_{yr}}{K_r} \rightarrow A_h \geqq A_r\left(\frac{F_{yr}}{F_{yh}}\right)\left(\frac{K_h}{K_r}\right)$$

$$A_h = \pi\frac{(D_h^2 - d_h^2)}{4} \rightarrow D_h = \sqrt{4\frac{A_h}{\pi} + d_h^2}$$

Geometric Observations:

$d_b > D_h$ and $d_b > d_s$ and $d_s \geqq D_h$ $\therefore d_b > d_s \geqq D_h$ Note: If $d_s = D_h$ then $\Theta = 0°$ Bearing of Ball on Socket:

Referring to FIG. 9

$$A_b \approx \pi(r_b^2 - r_s^2) \text{ or } \frac{\pi(d_b^2 - d_s^2)}{4}$$

$$\frac{A_bF_{ya}}{K_b} \geqq \frac{A_hF_{yh}}{K_h} \rightarrow A_b \geqq A_h\left(\frac{F_{yh}}{F_{ya}}\right)\left(\frac{K_b}{K_h}\right)$$

-continued $$\frac{A_b F_{yh}}{K_b} \geqq \frac{A_h F_{yh}}{K_h} \rightarrow A_b \geqq A_h \left( \frac{K_b}{K_h} \right)$$

Shear of Anchor Base Material:

$$\frac{A_{sh} F_{syA}}{K_{bs}} \geqq \frac{A_h F_{yh}}{K_h} \rightarrow A_{sh} \geqq A_h \left( \frac{F_{yh}}{F_{syA}} \right) \left( \frac{K_{bs}}{K_h} \right)$$

$$A_{sh} = 2\pi r_b h \text{ or } 2\pi \left( \frac{d_b}{2} \right) h \rightarrow \pi d_b(h)$$

Shear of ball (hub) material in socket:
Referring to FIG. 10

$$1 = 2\sqrt{r_b^2 - r_s^2} \quad 2\sqrt{\left(\frac{d_b^2}{2}\right)^2 - \left(\frac{d_s}{2}\right)^2}$$

$$\therefore A_{shb} = 2\pi r_s l \quad 2\pi \left( \frac{d_s}{2} \right) l \rightarrow \pi d_s(l)$$

$$\frac{A_{shb} F_{syh}}{K_{bs}} \geqq \frac{A_h F_{yh}}{K_h} \rightarrow A_{shb} \geqq A_h \left( \frac{F_{yh}}{F_{syh}} \right) \left( \frac{K_{bs}}{K_h} \right)$$

Rotation Angle of Ball in Socket (Θ):

$$\tan\theta = \left( \frac{d_s - D_h}{2} \right) / h \rightarrow \theta = \tan - 1 \left( \frac{d_s - D_h}{2} \right) / h$$

Although the invention has been described with reference to the preferred embodiment illustrated in the attached drawing figures, it is noted that substitutions may be made and equivalents employed herein without departing from the scope of the invention as recited in the claims.

We claim:

1. A screw anchor assembly adapted to be connected to a guy-wire comprising:
   - a main anchor body portion;
   - a tubular, open end, transversely polygonal hub connected to the main body portion of the anchor;
   - a lead point connected to the body of the anchor and projecting away from the open end of the hub;
   - a load bearing helix joined to the main body of the anchor in surrounding relationship to the hub and projecting outwardly therefrom in a helical direction;
   - an elongated anchor rod having means for securing the rod to said guy-wire;
   - an elongated boss having an outer length which is disposed within and extends longitudinally of the hub in spaced relationship from the inner wall surfaces of the hub,
   - said boss further having an inner segment joined to said outer length and provided with a portion which is recessed within and connected to the main body of the anchor; and
   - means on the anchor rod and boss respectively for affixing the rod to the end of the length of the boss remote from said segment thereof,
   - said segment of the boss being deflectable relative to the axis of the hub and thereby the helix to an extent that misalignment of the axis of the helix with a guy-wire connected to the anchor rod does not impose bending forces on the boss attributable to such misalignment that would result in failure of the boss when a predetermined load is imposed on the screw anchor assembly through the guy-wire of a magnitude that would cause failure of the boss in the absence of said deflection of the segment of the boss.

2. A screw anchor assembly as set forth in claim 1, wherein the segment of the boss is of less diameter than said length of the boss.

3. A screw anchor assembly as set forth in claim 2, wherein said portion of the boss segment recessed in the main body of the anchor has an enlarged section, and the main body of the anchor is provided with a socket complementally receiving the enlarged section and the portion of the boss segment recessed in the anchor body.

4. A screw anchor assembly as set forth in claim 3, wherein said segment of the boss including the enlarged section thereof is of generally inverted T-shape in cross-section.

5. A screw anchor assembly as set forth in claim 3, wherein said segment is elongated and of a length and cross-sectional dimensional permitting flexing of the segment in response to misalignment of the anchor with a guy-wire so as to limit adverse bending forces within said length of the boss.

6. A screw anchor assembly as set forth in claim 5, wherein said segment has radiused fillets joining opposite ends of the segment to the length of the boss and said enlarged section thereof respectively.

7. A screw anchor assembly as set forth in claim 5, wherein said means on the anchor rod and boss for affixing the rod to said length of the boss includes complementally engageable threads on the rod and boss respectively, the segment of the boss being sufficiently flexible to permit longitudinal bending thereof by misalignment of a guy-wire with the axis of the hub of the screw anchor and thereby the helix before fracture of said threads can occur.

8. A screw anchor assembly as set forth in claim 7, wherein said segment and the length of the boss are of approximately equal longitudinal dimensions.

9. A screw anchor assembly as set forth in claim 1, wherein said segment and the portion thereof recessed in the main body of the anchor are of generally spherical configuration, there being a socket in the main body pivotally receiving the spherical segment of the boss whereby the length of the boss receiving said anchor rod may deflect with respect to the axis in the hub and thereby the helix when the anchor is misaligned with respect to the guy-wire.

10. In a screw anchor adapted to be connected to a guy-wire through use of an elongated anchor rod and wherein the anchor has a main body that includes a tubular, open end, transversely polygonal hub, a lead point projecting from the anchor body in a direction away from the open end of the hub, and load bearing helix means connected to the hub and extending outwardly therefrom, the improved connection means for coupling the rod to the anchor body comprising:
   - an elongated boss for connecting the guy-wire anchor rod to the body of the anchor; and
   - means for securing one end of the boss to the body of the anchor in disposition within the hub but spaced from the inner wall surfaces thereof,
   - said securing means being constructed and the location of the boss means within the hub being such that deflection of the boss with respect to the central axis of the screw anchor defined by the axes of the hub and the helix, is permitted to an extent that misalignment of the axis of the helix with a guy-wire connected to the anchor rod does not impose bending forces on the boss attributable to such misalignment that would result in failure of the boss when a load is imposed on the screw anchor through the guy-wire of a magnitude that would cause failure of the boss in the absence of said deflection of the segment of the boss.

11. In a screw anchor as set forth in claim 10, wherein said boss means includes an outer length which is disposed within and extends longitudinally of the hub in spaced relationship from the inner wall surfaces of the hub, said hub further having an inner segment joined to said outer length of the boss and provided with a portion which is recessed within the main body of the anchor for securing the boss to the main body of the anchor, said segment of the boss being deflectable relative to the axis of the hub and thereby the helix to an extent that adverse bending forces on said length of the boss attributable to misalignment of a guy-wire connected to the anchor rod are limited to a level below that where failure of the boss can occur under the loads imposed on the anchor.

12. A screw anchor assembly as set forth in claim 11, wherein the segment of the boss is of less diameter than said length of the boss.

13. A screw anchor assembly as set forth in claim 12, wherein said portion of the boss segment recessed in the main body of the anchor has an enlarged section, and the main body of the anchor is provided with a socket complementally receiving the enlarged section and the portion of the boss segment recessed in the anchor body.

14. A screw anchor assembly as set forth in claim 13, wherein said segment of the boss including the enlarged section thereof is of generally inverted T-shape in cross-section.

15. A screw anchor assembly as set forth in claim 13, wherein said segment is elongated and of a length and cross-sectional dimensional permitting flexing of the section to a greater extent than the said length of the boss so that adverse bending forces are not applied to said length of the boss by misalignment of the anchor with a guy-wire.

16. A screw anchor assembly as set forth in claim 15, wherein said segment has radiused fillets joining opposite ends of the segment to the length of the boss and said enlarged section thereof respectively.

17. A screw anchor assembly as set forth in claim 15, wherein said means on the anchor rod and boss for affixing the rod to said length of the boss includes complementally engageable threads on the rod and boss respectively, the segment of the boss being sufficiently flexible to permit longitudinal bending thereof by misalignment of a guy-wire with the axis of the hub of the screw anchor and thereby the helix before fracture of said threads can occur.

18. A screw anchor assembly as set forth in claim 17, wherein said segment and the length of the boss are of approximately equal longitudinal dimensions.

19. A screw anchor assembly as set forth in claim 10, wherein said segment and the portion thereof recessed in the main body of the anchor are of generally spherical configuration, there being a socket in the main body pivotally receiving the spherical segment of the boss whereby the length of the boss receiving said anchor rod may deflect with respect to the axis in the hub and thereby the helix when the anchor is misaligned with respect to the guy-wire.

20. In an anchor assembly of the type adapted to be connected to a guy-wire and provided with a main anchor body, earth engaging load bearing structure projecting outwardly from the main body, and an elongated anchor rod having first and second ends with means being provided adjacent the first end of the rod for securing the rod to the guy-wire, the combination with said anchor an elongated boss provided with a portion which is recessed within and connected to the main body of the anchor; and means on said second end of the anchor rod and the outer extremity of the boss remote from the portion thereof recessed in the main body of the anchor for releasably affixing the rod to the boss, the segment of the boss between the portion thereof recessed within the main body of the anchor, and said outer extremity of the boss being deflectable relative to the aligned axes of the rod and boss to an extent that misalignment of the axis of the boss with a guy-wire connected to the anchor rod does not impose bending forces on the boss attributable to such misalignment that would result in failure of the boss when a load is imposed on the anchor through the guy-wire of a magnitude that would cause failure of the boss in the absence of said deflection of the segment of the boss.

* * * * *